US010654155B2

(12) United States Patent
Meyer et al.

(10) Patent No.: US 10,654,155 B2
(45) Date of Patent: May 19, 2020

(54) RETURN MECHANISM FOR A CORDLESS NAILER

(71) Applicant: Black & Decker Inc., New Britain, CT (US)

(72) Inventors: Jeffrey J. Meyer, Baltimore, MD (US); Stuart E. Garber, Towson, MD (US)

(73) Assignee: Black & Decker Inc., New Britain, CT (US)

( * ) Notice: Subject to any disclaimer, the term of this patent is extended or adjusted under 35 U.S.C. 154(b) by 414 days.

(21) Appl. No.: 15/630,044

(22) Filed: Jun. 22, 2017

(65) Prior Publication Data

US 2018/0001455 A1 Jan. 4, 2018

Related U.S. Application Data

(60) Provisional application No. 62/356,656, filed on Jun. 30, 2016.

(51) Int. Cl.
*B25C 1/00* (2006.01)
*B25C 1/06* (2006.01)

(52) U.S. Cl.
CPC ..... *B25C 1/06* (2013.01); *B25C 1/008* (2013.01)

(58) Field of Classification Search
CPC ..... B25C 1/06; B25C 1/001; B25C 1/008
USPC ..... 227/131
See application file for complete search history.

(56) References Cited

U.S. PATENT DOCUMENTS

| | | | |
|---|---|---|---|
| 1,526,025 | A | 2/1925 | Street |
| 2,822,698 | A | 2/1958 | Gross |
| 8,011,441 | B2 | 9/2011 | Leimbach et al. |
| 8,011,547 | B2 | 9/2011 | Leimbach et al. |
| 8,230,941 | B2 | 7/2012 | Leimbach et al. |
| 8,267,296 | B2 | 9/2012 | Leimbach et al. |
| 8,267,297 | B2 | 9/2012 | Leimbach et al. |
| 8,286,722 | B2 | 10/2012 | Leimbach et al. |
| 8,387,718 | B2 | 3/2013 | Leimbach et al. |

(Continued)

FOREIGN PATENT DOCUMENTS

| | | | |
|---|---|---|---|
| EP | 2711135 | A2 | 3/2014 |
| GB | 602455 | A | 5/1948 |
| WO | WO-2009/046076 | A1 | 7/2010 |

OTHER PUBLICATIONS

International Search Report and Written Opinion dated Oct. 12, 2017 in corresponding International Patent Application No. PCT/US2017/039981.

*Primary Examiner* — Chelsea E Stinson
(74) *Attorney, Agent, or Firm* — Harness, Dickey & Pierce, P.L.C.

(57) ABSTRACT

A driver return assembly can be positioned to return a concrete nail driver of a cordless electric powered nailer to the home position. A return rack can be fixedly coupled to and positioned along a longitudinal length of the concrete nail driver The driver return assembly can include a solenoid driving a plunger in a reciprocating motion in a homeward direction and a driven direction. A return pawl can be coupled to the plunger and pivotable into a pawl raised position relative to the plunger in which the pawl is engageable with the return rack during movement of the plunger in the homeward direction, and pivotable into a pawl lowered position relative to the plunger in which the pawl is not engageable with the return rack during movement of the plunger in the driven direction.

31 Claims, 9 Drawing Sheets

(56) References Cited

U.S. PATENT DOCUMENTS

| | | | | |
|---|---|---|---|---|
| 8,505,798 | B2 | 8/2013 | Simonelli et al. | |
| 8,602,282 | B2 | 12/2013 | Leimbach et al. | |
| 8,777,081 | B2 | 7/2014 | Chen et al. | |
| 9,346,158 | B2 | 5/2016 | Garber et al. | |
| 2009/0250500 | A1* | 10/2009 | Brendel | B25C 1/06 227/132 |
| 2011/0198381 | A1* | 8/2011 | McCardle | B25C 1/047 227/8 |
| 2012/0061443 | A1 | 3/2012 | Chen et al. | |
| 2014/0069671 | A1 | 3/2014 | Leimbach et al. | |
| 2014/0076952 | A1 | 3/2014 | Garber et al. | |
| 2014/0097223 | A1 | 4/2014 | Baron et al. | |
| 2015/0096776 | A1* | 4/2015 | Garber | B25C 1/00 173/1 |
| 2015/0352702 | A1 | 12/2015 | Chien | |
| 2019/0299380 | A1* | 10/2019 | Meyer | B25C 1/06 |

* cited by examiner

RETURN MECHANISM FOR A CORDLESS NAILER

CROSS-REFERENCE TO RELATED APPLICATIONS

This application claims the benefit of U.S. Provisional Application No. 62/356,656, filed on Jun. 30, 2016. The entirety of the above application is incorporated herein by reference.

FIELD

The present disclosure relates to a return mechanism for a cordless nailer.

BACKGROUND

This section provides background information related to the present disclosure which is not necessarily prior art.

Fastening tools, such as power nailers have become relatively common place in the construction industry. Pneumatically-powered nailers, which are connected to an air compressor via an air hose, and powder nailers, which employ a powder fuel source that is rapidly combusted to produce a volume of pressurized gas, initially dominated the market. Both products, however, suffer from several drawbacks.

Pneumatically powered nailers require a relatively expensive air compressor that can be relatively cumbersome to transport. Additionally, it can be inconvenient to operate the nailer while it is tethered (via the air hose) to the air compressor. Many of the nailers powered by a powder fuel source are of the "single shot" variety and require significant effort to reload. Additionally, nailers employing a powder fuel source can be relatively noisy and can produce unpleasant odors during their operation.

Despite these limitations, pneumatic and powder-powered nailers continue to predominate for those construction applications, such as steel framing and concrete construction, which employ fasteners requiring a high degree of power to install the fasteners. Hence, while cordless electric nailers have become very successful for use in conventional wood construction (i.e., framing and trimming), cordless electric power nailers of this type are presently not suitable for use in steel framing or concrete construction applications.

Cordless electric powered nailers typically use springs to return the nail driver of the tool to its home position. A cordless electric powered nailer that is capable of installing concrete fasteners, including the installation of hardened fasteners through steel framing into concrete, must impart a significant amount of energy to the concrete fastener. Such driver return springs are prone to failure when subjected to the energy required to drive concrete fasteners. Accordingly, a much more robust and capable driver return mechanism is desired to improve the reliability of cordless electric powered nailers, including those capable of installing concrete fasteners.

SUMMARY

This section provides a general summary of the disclosure, and is not a comprehensive disclosure of its full scope or all of its features. In addition, any feature or combination of features included in this general summary is not necessarily critical or particularly important to the disclosure.

In accordance with an aspect of the disclosure, a cordless electric nailer can include a power take-off assembly positioned and operable to selectively engage a pinch roller against a nail driver having a home position to pinch the nail driver against a battery-powered electric motor driven flywheel and fire the nail driver. A return rack can be fixedly coupled to and positioned along a longitudinal length of the nail driver. A driver return assembly can be positioned to engage and return the nail driver to the home position. The driver return assembly can include a return motor operably coupled to a return pawl to alternating drive the return pawl in a homeward direction while the return pawl is in a raised position relative to the nail driver in which the return pawl is engageable with the return rack, and in a driven direction while the return pawl is in a lowered position relative to the nail driver in which the return pawl is not engageable with the return rack.

In accordance with another aspect of the disclosure, a cordless electric concrete nailer can include a power take-off assembly positioned and operable to selectively engage a pinch roller against a concrete nail driver having a home position to pinch the concrete nail driver against a battery-powered electric motor driven flywheel and fire the concrete nail driver. A return rack can be fixedly coupled to and positioned along a longitudinal length of the concrete nail driver. A driver return assembly can be positioned to return the concrete nail driver to the home position. The driver return assembly can include a solenoid driving a plunger in a reciprocating motion in a homeward direction and a driven direction. A return pawl can be coupled to the plunger and pivotable into a pawl raised position relative to the plunger in which the pawl is engageable with the return rack during movement of the plunger in the homeward direction, and pivotable into a pawl lowered position relative to the plunger in which the pawl is not engageable with the return rack during movement of the plunger in the driven direction.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
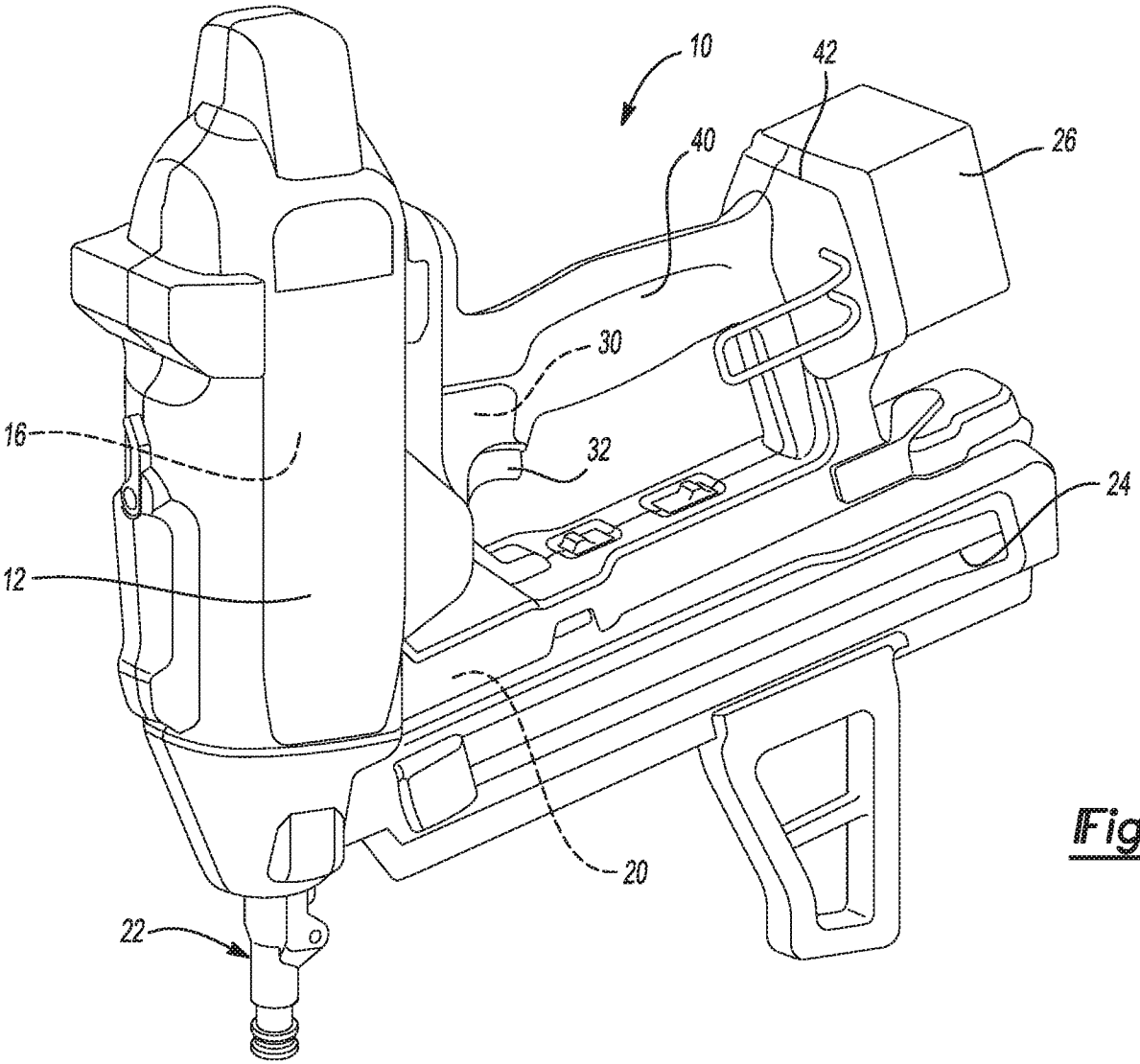
FIG. 1 is a perspective view of an exemplary nailer constructed in accordance with the teachings of the present disclosure.
Figure 2:
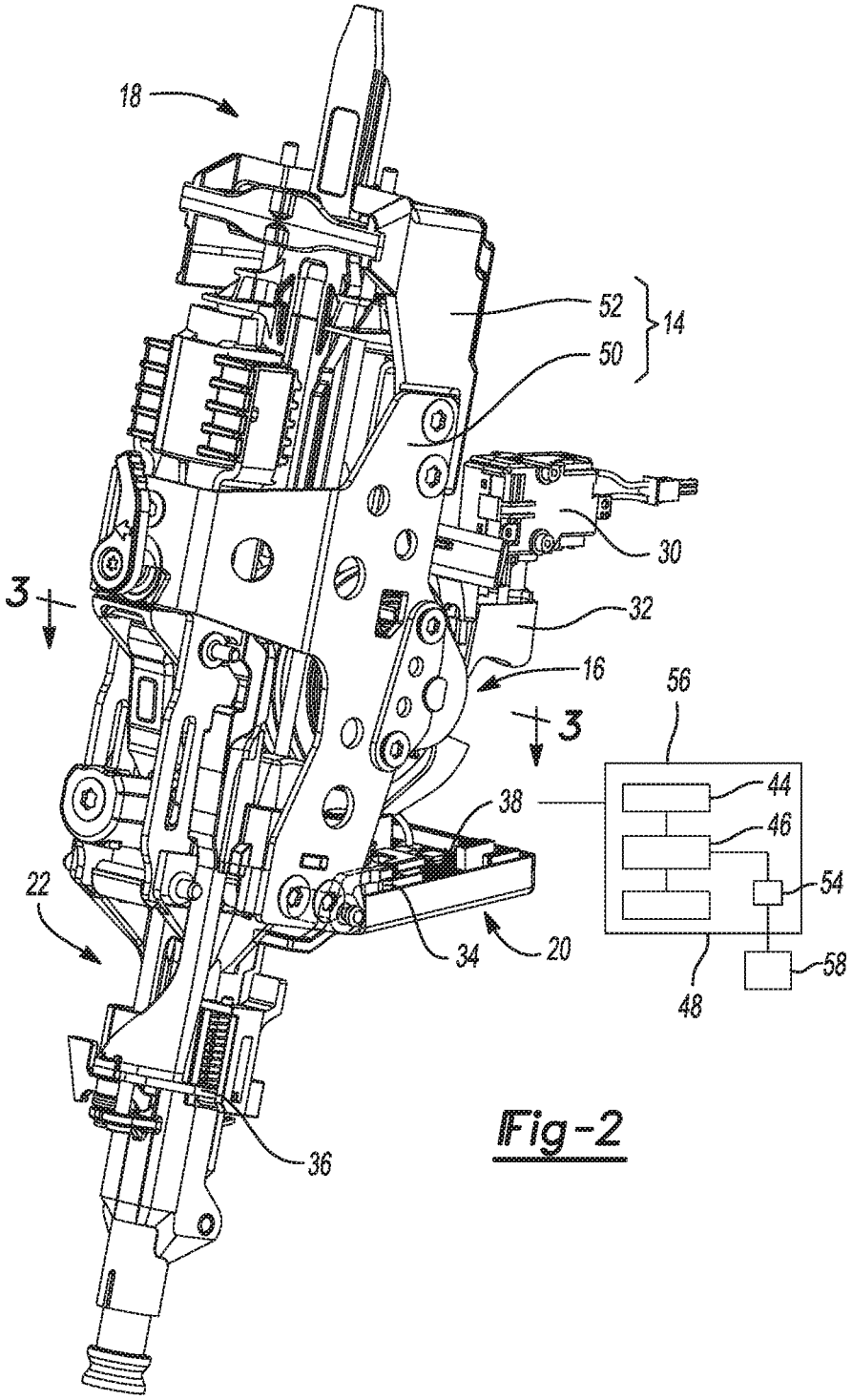
FIG. 2 is a perspective view of a portion of the nailer of FIG. 1.

With reference to FIGS. 1 and 2 of the drawings, a cordless nailer constructed in accordance with the teachings of the present disclosure is generally indicated by reference numeral 10. The driving tool 10 can include a housing 12, a frame 14, a drive motor assembly 16, a driver return mechanism or assembly 18, a control unit 20, a nosepiece assembly 22, a magazine assembly 24 and a battery pack 26. The nosepiece assembly 22, the magazine assembly 24 and the battery pack 26 can be constructed in a conventional manner and as such, need not be described in detail herein. The control unit 20 can include various switches, such as a trigger switch 30, which is responsive to a state of a trigger 32, and a contact trip switch 34, which is responsive to a state of a contact trip 36 associated with the nosepiece assembly 22, various sensors, such as a motor speed sensor (not shown), and a controller 38 that can receive signals from the various switches and sensors and responsively operate the drive motor assembly 16 and the driver return assembly 18.

The housing 12 can be of a clam-shell construction that can be employed to cover various components of the nailer 10, such as the drive motor assembly 16, the driver return assembly 18 and the control unit 20. The housing 12 can form a handle 40 that can be grasped by the operator of the nailer 10 to operate the nailer 10, and a battery pack mount 42 to which the battery pack 26 can be fixedly but removably coupled.

The frame 14 can formed of one or more frame components and is the structure to which the drive motor assembly 16, the driver return assembly 18 and the nosepiece assembly 22 can be fixedly coupled. In the particular example provided, the frame 14 comprises a motor mount 50 and a return mechanism mount 52 that are fixedly coupled to one another via a plurality of threaded fasteners (not specifically shown).

Figure 3:
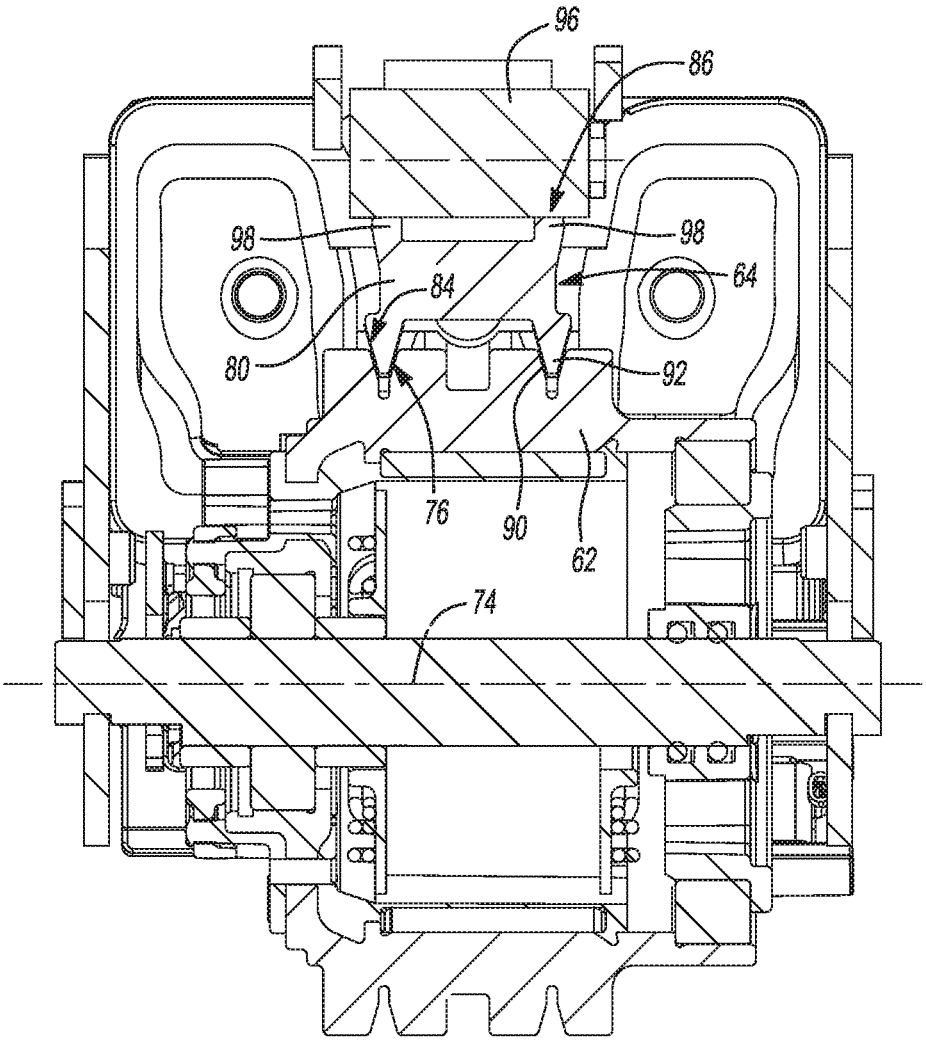
FIG. 3 is a section view taken through a portion of the nailer of FIG. 1, depicting a flywheel, a driver and a pinch roller in more detail.
Figure 4:
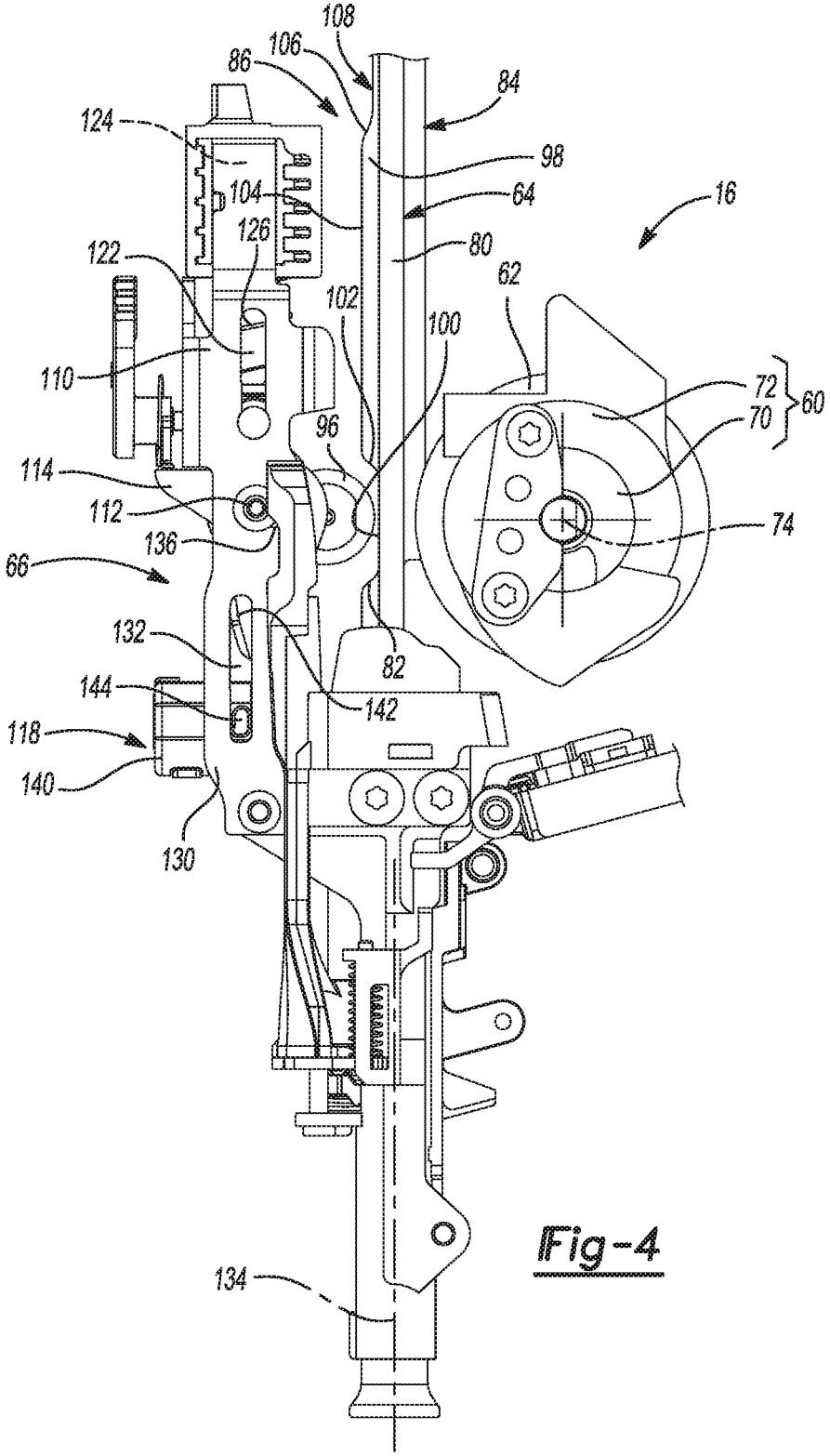
FIG. 4 is a side elevation view of a portion of the nailer of FIG. 1.

With reference to FIGS. 3 and 4, the drive motor assembly 16 can comprise an electric motor 60, a flywheel 62, a driver 64 and a power take-off unit (PTU) or power take-off assembly 66. The electric motor 60 can be an inside-out motor having a stator 70, which is fixedly coupled to the motor mount 50 (FIG. 2), and a rotor 72 that can be disposed about (i.e., radially outwardly of) the stator 70. The flywheel 62 can be disposed about (i.e., radially outwardly of) and fixedly coupled to the rotor 72 such that the rotor 72 and the flywheel 62 are rotatable about a common rotational axis 74. As best shown in FIG. 3, the flywheel 62 can have a flywheel profile 76 on its outer circumferential surface.

Figure 5:
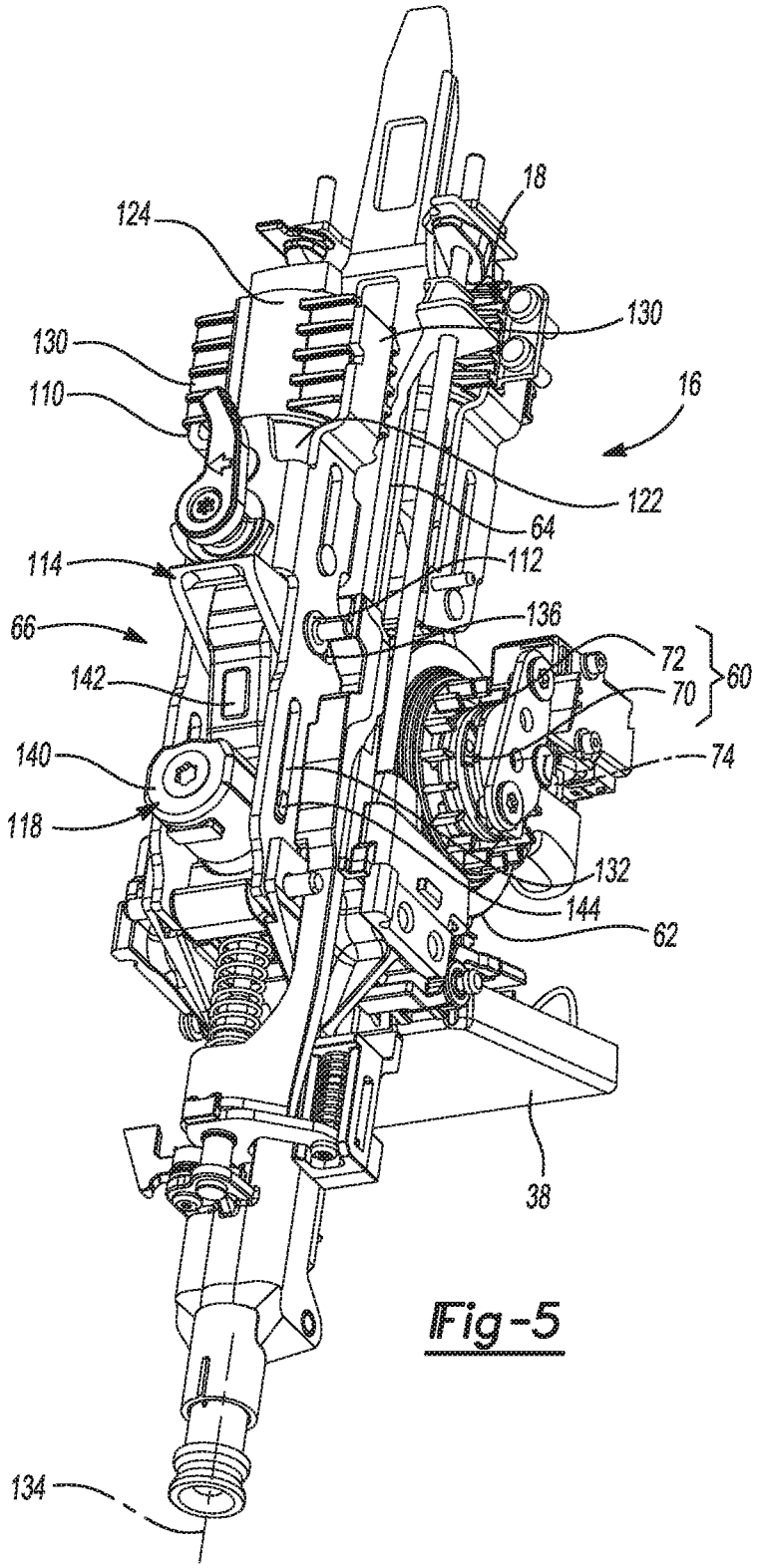
FIG. 5 is a perspective view of a portion of the nailer of FIG. 1, illustrating a drive motor assembly in more detail.

With reference to FIGS. 3 through 5, the driver 64 can include a driver body 80 and a driver blade 82. The driver body 80 can have a driver profile 84 on a first surface, and a cam profile 86 on a second surface that is opposite the first surface. The driver profile 84 is configured to meshingly engage the flywheel profile 76 on the flywheel 62. The flywheel profile 76 and driver profile 84 can cooperate to provide increased surface area over which the flywheel 62 and the driver 64 contact one another (relative to a configuration that employs a cylindrically-shaped surface on the flywheel 62 and a flat surface on the driver 64) and/or can provide a configuration that maintains a desired level of contact between the flywheel 62 and the driver 64 despite the occurrence of wear on one or both of the flywheel 62 and the driver 64. In the example provided, resistance to wear is created through the use of V-shaped grooves 90 in the flywheel profile 76 and mating V-shaped ribs 92 on the driver profile 84. The driver blade 82 can be integrally and unitarily formed with the driver body 80 from an appropriate material, such as ISI 6150 steel. The cam profile 86 is configured to be contacted by a pinch roller 96 of the PTU 66. The cam profile 86 cooperates with the PTU 66 to coordinate the generation of a clamping force that is transmitted between the driver profile 84 and the flywheel profile 76. In the example provided, the cam profile 86 includes a pair of contoured rails 98, each of which having a first rest portion 100, a loading ramp 102, a sustained load portion 104, an unloading ramp 106 and a second rest portion 108. The first and second rest portions 100 and 108 are generally flat and are sized so that no or relatively little clamp load is generated when the pinch roller 96 is disposed on either of those portions. The sustained load portion 104 is configured to cooperate with the PTU 66 to generate a clamping force that is within a predetermined load range. The loading ramp 102 tapers from the first rest portion 100 to the sustained load portion 104, while the unloading ramp 106 tapers from the sustained load portion 104 to the second rest portion 108.

Figure 6:
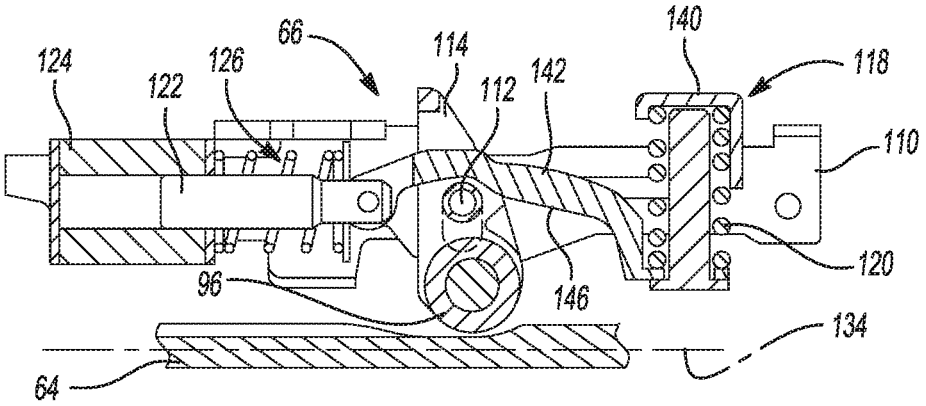
FIG. 6 is a longitudinal section view of a portion of the nailer of FIG. 1, illustrating the drive motor assembly in more detail.

With reference to FIGS. 4 through 6, the PTU 66 can include an activation arm 110, a yoke axle 112, a pinch roller yoke 114, the pinch roller 96, a spring mount 118, a spring 120, a plunger 122, a PTU solenoid 124 and a solenoid spring 126. The activation arm 110 can be fixedly coupled to the motor mount 50 (FIG. 2) and can include a pair of arm members 130, each of which defining a spring slot 132, which can be disposed generally parallel to a longitudinal driver axis 134 along which the driver 64 can translate, and an axle slot 136 that can be disposed generally perpendicular to the driver axis 134. The yoke axle 112 can be received into the axle slots 136 in the arm members 130 so that the yoke axle 112 can rotate about its axis within the axle slots 136 and can move generally perpendicular to the driver axis 134 relative to the activation arm 110. The pinch roller yoke 114 can be pivotably mounted on the yoke axle 112. The pinch roller 96 can be rotatably mounted to the pinch roller yoke 114 at a location that is offset from the yoke axle 112. The spring mount 118 can include a spring seat 140 and a spring arm 142. The spring 120 can be received in the spring mount 118 such that a first end of the spring 120 abuts the spring seat 140 and a second, opposite end of the spring 120 abuts an end of the spring arm 142. The spring mount 118 can include a pair of tabs 144, each of which being received in a corresponding one of the spring slots 132. The spring arm 142 defines an axle cam 146 that contacts the yoke axle 112. The plunger 122 is coupled to an end of the spring arm 142 that is opposite the spring 120 and the spring mount 118. The solenoid spring 126 is configured to bias the plunger 122 away from the PTU solenoid 124 and toward the spring seat 140. The PTU solenoid 124 is configured to selectively generate a magnetic field that draws the plunger 122 in a direction that is parallel to the driver axis 134 into the PTU solenoid 124 against the bias of the solenoid spring 126. Movement of the plunger 122 toward the PTU solenoid 124 causes corresponding motion of the spring arm 142, and therefore corresponding translation of the axle cam 146 across the yoke axle 112, which causes the axle cam 146 to drive the yoke axle 112 (and therefore the pinch roller yoke 114 and the pinch roller 96) in a direction generally perpendicular to the driver axis 134 and toward the flywheel 62.

Operation of the PTU solenoid 124 when the flywheel 62 is rotated within a predetermined speed range will cause the plunger 122 to move the spring mount 118 toward the PTU solenoid 124 so that the axle cam 146 drives the yoke axle 112, and therefore the pinch roller 96, toward the flywheel 62. Initial contact between the pinch roller 96 and the first rest portion 100 of the cam profile 86 drives the driver profile 84 into contact with the (rotating) flywheel profile 76 so that the rotational energy of the flywheel 62 begins to drive the driver 64 along the driver axis 134 from a driver returned position or driver "home" position to a driver extended position or driver "driven" position. Movement of the driver 64 along the driver axis 134 toward the driver extended or driven position causes the pinch roller 96 to ride up the loading ramp 102 and onto the sustained load portion 104, which drives the yoke axle 112 away from the flywheel 62. Movement of the yoke axle 112 away from the flywheel 62 correspondingly moves the spring arm 142 so that the spring 120 is compressed between the spring seat 140 and the end of the spring arm 142. A corresponding reaction force is applied through the yoke axle 112, the pinch roller yoke 114, and the pinch roller 96 to the driver 64 to provide the clamping force that drives the driver profile 84 into the flywheel profile 76 so that the rotational energy of the flywheel 62 can be rapidly transmitted to the driver 64 to rapidly accelerate the driver 64 along the driver axis 134. Compression of the spring 120 is released as the unloading ramp 106 travels over pinch roller 96. Additionally, the pinch roller yoke 114 pivots about the yoke axle 112 so that the pinch roller 96 pivots toward the PTU solenoid 124 when the pinch roller 96 is disposed over the second rest portion 108. Thereafter, the driver return assembly 18 can be selectively operated by the controller 38 to return the driver 64 from the driver extended or driven position to the driver returned or home position.

Figure 7:
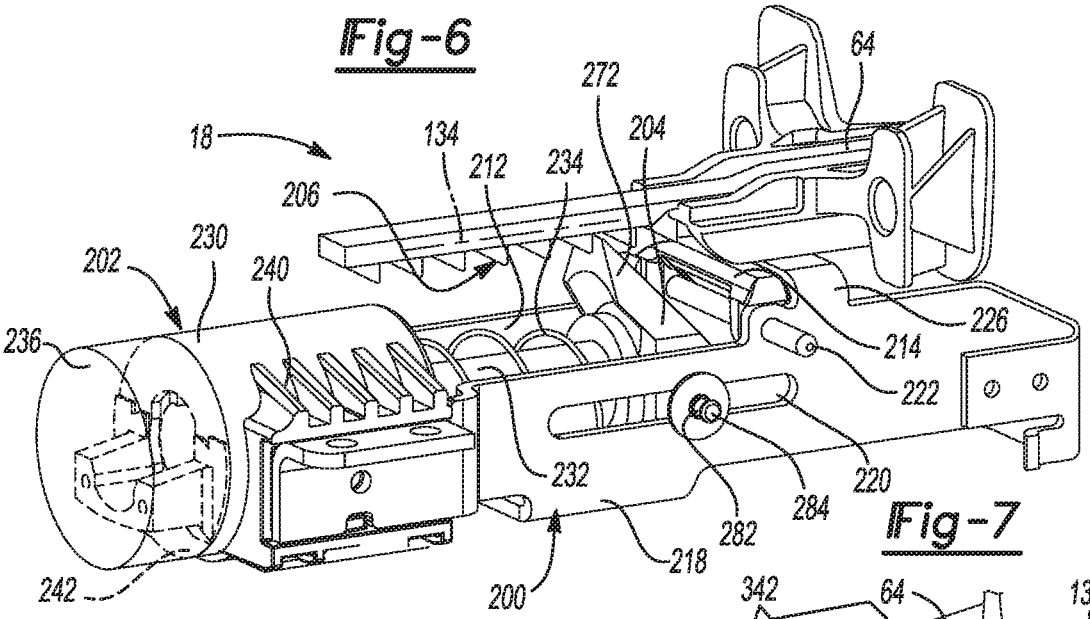
FIG. 7 is a perspective view of a portion of the nailer of FIG. 1, illustrating a return mechanism in more detail.
Figure 8:
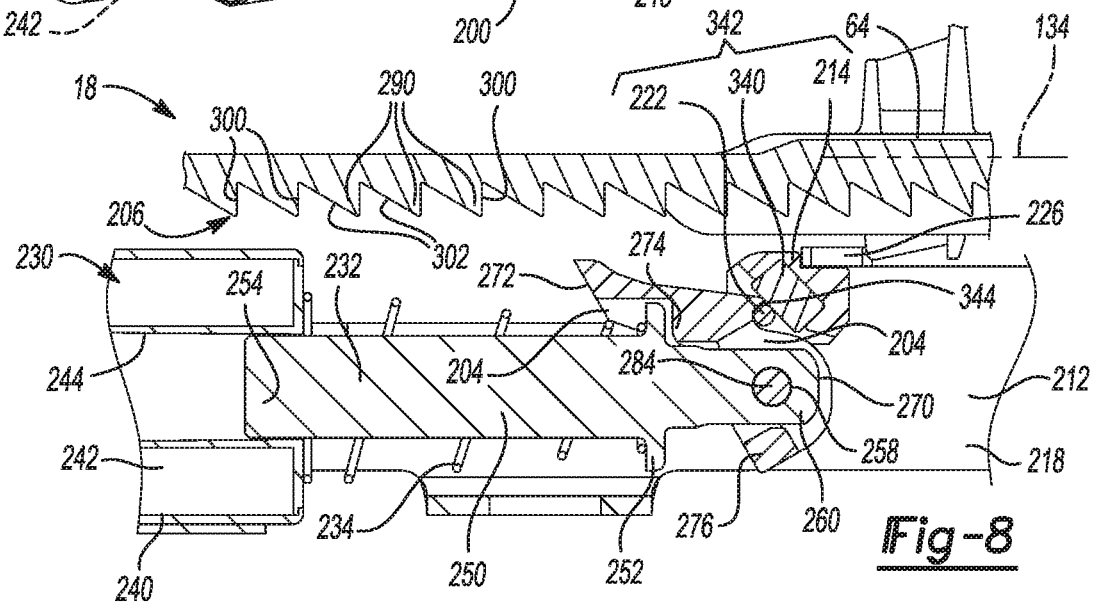
FIG. 8 is a longitudinal section view of a portion of the return mechanism.

With reference to FIGS. 7 and 8, the driver return assembly 18 comprises a return mount 200, a return motor 202, a return pawl 204, and a return rack 206. As illustrated, both the power take-off assembly 66 and the driver return assembly 18 can be positioned on the same side of the driver 64. The return mount 200 can include a first girder 210, a second girder 212 and a link 214 that is coupled to the first and second girders 210 and 212. The first and second girders 210 and 212 can be formed of sheet steel and can be fixedly coupled to the return mechanism mount 52 (FIG. 2) below the driver 64. Each of the first and second girders 210 and 212 can have a side wall 218 that can define a pivot pin slot 220 that can be arranged generally parallel to the driver axis 134. The link 214 can be formed of any suitable material, such as a plastic material and can be coupled to the first and second girders 210 and 212 in any desired manner. In the particular example provided, the link 214 rests on side walls 218 of the first and second girders 210 and 212, a pin 222 is disposed through holes in the side walls 218 and the link 214, and the link 214 abuts a pair of girder tabs 226. Each of the girder tabs 226 can extend generally perpendicular from the side wall 218 of the associated one of the first and second girders 210 and 212 toward the other one of the girder tabs 226.

Figure 13:
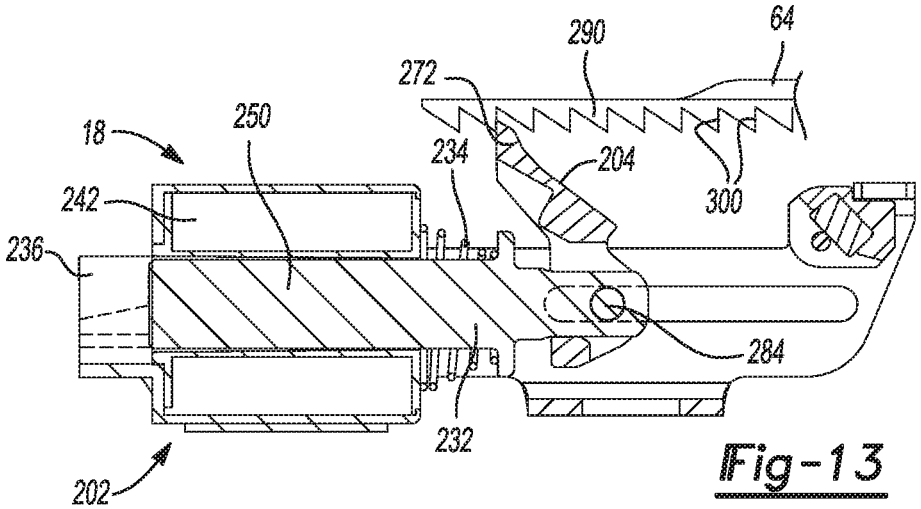

The return motor 202 can comprise a solenoid 230, a plunger 232, a return spring 234, and a bumper 236. The solenoid 230 can include a solenoid housing 240, which can be fixedly coupled to and span between the first and second girders 210 and 212, and an electromagnetic coil 242 that can be received in the solenoid housing 240. The solenoid housing 240 can define a plunger aperture 244. The plunger 232 can have a plunger body 250 and a plunger flange 252. A proximal end 254 of the plunger body 250 can be cylindrically shaped and can be received into the plunger aperture 244 in the solenoid housing 240. A first pin bore 258 can be formed into a distal end 260 of the plunger body 250. The plunger flange 252 can extend radially outwardly from the plunger body 250 proximate the distal end 260. The return spring 234 can be a compression spring that can be received about the plunger body 250 between the plunger flange 252 and the solenoid housing 240. In the example provided, the return spring 234 is wound in a conical manner so that a larger diameter end of the return spring 234 is abutted against the solenoid housing 240, while a smaller diameter end of the return spring 234 is abutted against the plunger flange 252. The return spring 234 can bias the plunger 232 into an extended position (shown in FIG. 8) in which the first pin bore 258 is disposed a first distance away from the solenoid housing 240. The bumper 236 can be a foam bumper and the plunger 232 can engage against the foam bumper 236 to absorb some momentum of the plunger 232 to stop the plunger 232 as it moves into its fully retracted position. This can help reduce some of the forces that the solenoid return spring 234 absorbs, which can significantly extend the life of the return spring 234 and the overall reliability of the nailer 10. The bumper 236 can also facilitate immediate or essentially instantaneous reversal in movement of the plunger 232 from movement toward the retracted position to movement toward the extended position. The resulting forces on the plunger 232 can facilitate or speed pivotal movement of the return pawl 204 from its raised position to its lowered position, which positions are illustrated in, e.g., FIGS. 13 and 14, respectively, and described below. The electromagnetic coil 242 can be operated to generate a magnetic field that can move the plunger 232 toward the solenoid housing 240/electromagnetic coil 242 so that the first pin bore 258 is disposed a second, smaller distance away from the solenoid housing 240.

The return pawl 204 can comprise a pawl body 270, a pawl tooth 272, a return stop 274 and an extend stop 276. The pawl body 270 can be a yoke-shaped structure that can be disposed about the plunger body 250 and can define a second pin bore 282 that can be aligned to the first pin bore 258. A pivot pin 284 can be received through the first and second pin bores 258 and 282 to thereby pivotably couple the pawl body 270 to the distal end 260 of the plunger body 250. The pivot pin 284 can be received in the pivot pin slots 220 and can extend through the first and second girders 210 and 212. It will be appreciated that the pivot pin 284 can cooperate with the first and second girders 210 and 212 to inhibit rotation of the plunger 232 and the return pawl 204 about a longitudinal axis of the plunger 232. The pawl tooth 272 can be fixedly coupled to the pawl body 270 and can be configured to engage the return rack 206. The return stop 274 and the extend stop 276 can be fixedly coupled to the pawl body 270 on opposite sides of the second pin bore 282. The return pawl 204 can pivot about the pivot pin 284 relative to the plunger 232 between a pawl returned or lowered position (shown in FIG. 8), in which the return stop 274 is abutted against the plunger flange 252 and the pawl tooth 272 is in a lowered position, and a pawl extended or raised position in which the extend stop 276 is abutted against the plunger flange 252 and the pawl tooth 272 is in a raised position. Thus, the return pawl 204 can be coupled to a component, e.g., plunger 232, of the return motor via a pivot pin 248, and the return pawl 204 can be pivotable about the pivot pin 248 away from the return motor component 232 into the raised position, and pivotable about the pivot pin 248 toward the return motor component 232 into the lowered position.

As in the illustrated example, the return rack 206 can be positioned along a longitudinal length of the nail driver 64 and at an upper end of the nail driver 64 that is opposite its driving end. The return rack 206 can comprise a plurality of rack teeth 290 that can be fixedly coupled to (e.g., unitarily and integrally formed with) the driver 64. The rack teeth 290 can be disposed on a lower side of the driver 64 in an area that is opposite the driver profile 84 (on the driver 64) that is configured to engage the flywheel profile 76 (on the flywheel 62). Each of the rack teeth 290 can have a tooth engagement face 300, which is disposed generally perpendicular to a longitudinal axis of the driver 64, and a relief face 302 that tapers from the distal end of the tooth engagement face 300 toward the upper side of the driver 64 and terminates at the tooth engagement face 300 of an adjacent one of the rack teeth 290.

As described above, the controller 38 can control the operation of the electric motor 60 (FIG. 4) and the PTU solenoid 124 (FIG. 4) to cause the driver 64 to be rapidly propelled along the driver axis 134 to the driver extended or driven position. Thereafter, the controller 38 (FIG. 2) can deactivate the PTU solenoid 124 (FIG. 4). When a predetermined amount of time has elapsed after the PTU solenoid 124 (FIG. 4) has been deactivated, the return motor 202 can be operated to cause the driver return assembly 18 to drive the driver 64 to the driver return or home position. FIGS. 9 through 14 depict the driver return assembly 18 through one complete cycle in the operation of the return motor 202.

Figure 9:
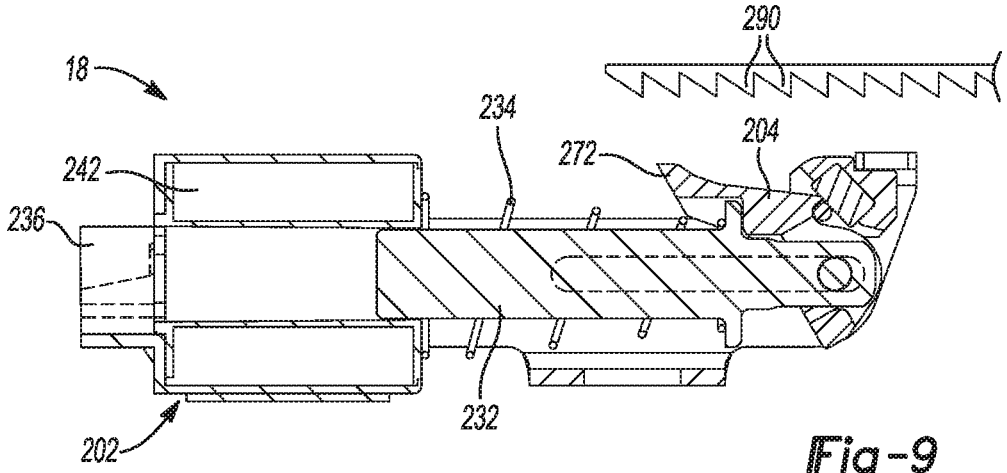
FIGS. 9-14 are schematic views of a portion of the return mechanism illustrating the operation of the return mechanism through one cycle of a return motor.

With reference to FIG. 9, the plunger 232 is in the plunger extended position and the return pawl 204 is disposed in the pawl returned position so that the pawl tooth 272 is in its lowered position and spaced apart from the rack teeth 290.

Figure 10:
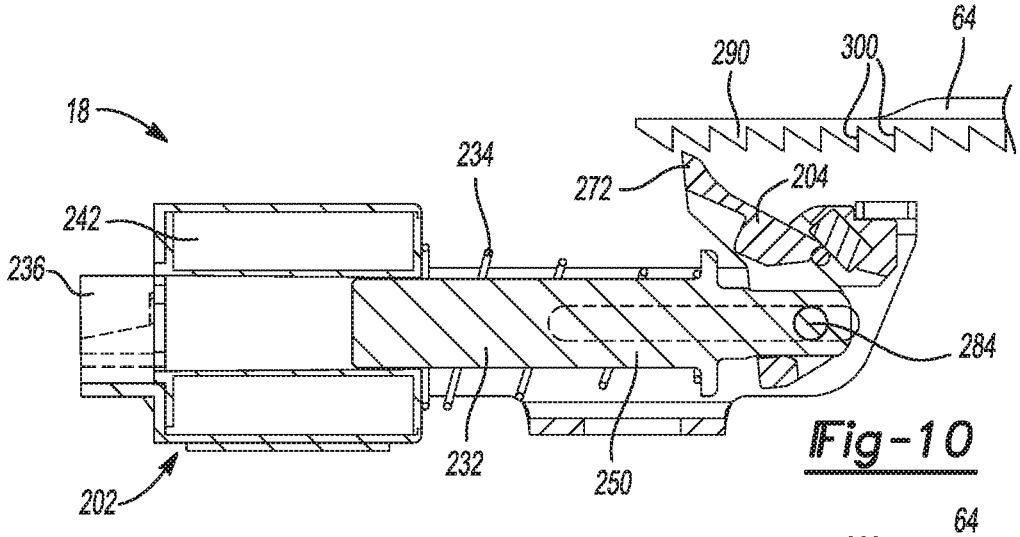
Figure 11:
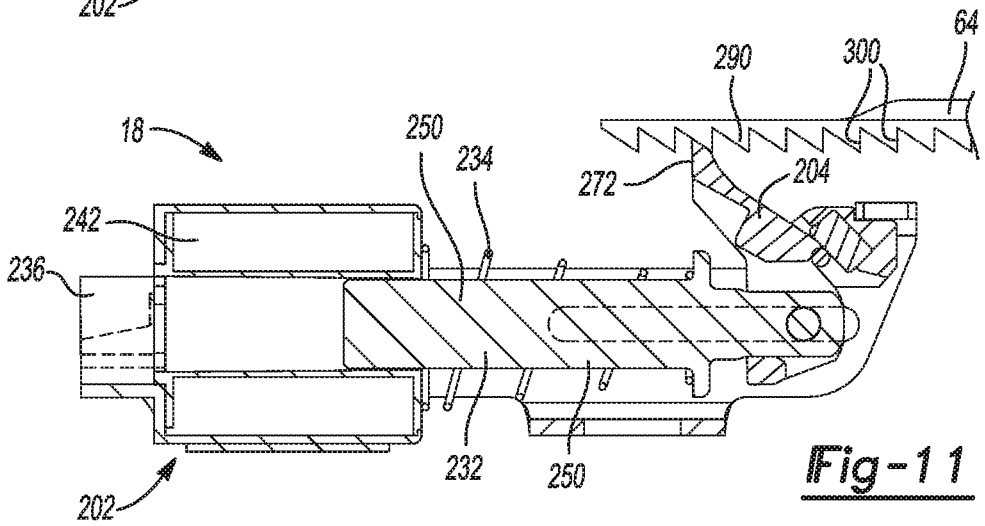

With reference to FIG. 10, electric power can be provided to the electromagnetic coil 242 to generate a magnetic field that draws the plunger body 250 into the electromagnetic coil 242. It will be appreciated that translation of the plunger body 250 into the electromagnetic coil 242 causes the pivot pin 284 to correspondingly translate with the plunger body 250. It is desirable that the return pawl 204 pivot about the pivot pin 284 in a relatively rapid manner as the plunger 232 is moved from the extended position toward the retracted position to cause the pawl tooth 272 to move from the lowered position to the raised position. It will be appreciated the return pawl 204 can be rotated about the pivot pin 284 by any desired means, such as a torsion spring (not shown). In the particular example provided, however, a magnet assembly 342 includes link 214, a permanent magnet 340 and a pin 222. The permanent magnet 340 (FIG. 8) is mounted to the link 214 (FIG. 8) and the magnet assembly 342, via the permanent magnet 340, the link 214, the pin 222, or any combination thereof, can include a surface 344 that is arranged to contact the return pawl 204 when the plunger 232 is disposed in the extended position. Contact between the surface 344 of the permanent magnet assembly 342 (FIG. 8) and the return pawl 204 when the plunger 232 is moved from the retracted position to the extended position can aid in rotating the return pawl 204 about the pivot pin 284 to move the pawl tooth 272 from the raised position to the lowered position and retain it there while the plunger 232 is in the extended position. When the plunger 232 is moved from the extended position toward the retracted position, the magnetic field of the permanent magnet 340 (FIG. 8) can cooperate with the ferro-magnetic material of the return pawl 204 to bias or draw the pawl tooth 272 toward the permanent magnet 340 (FIG. 8) as the pivot pin 284 is moved in an opposite direction toward the electromagnetic coil 242, which can correspond to a driven direction. The moment that is applied to the return pawl 204 (i.e., by the biasing magnetic force and the force of the plunger 232) can cause the return pawl 204 to pivot about the pivot pin 284 as the plunger 232 is moved toward the retracted position so that the pawl tooth 272 moves from the lowered position into the raised position such that the pawl tooth 272 is disposed between an adjacent pair of the rack teeth 290 as shown in FIG. 11.

Figure 12:
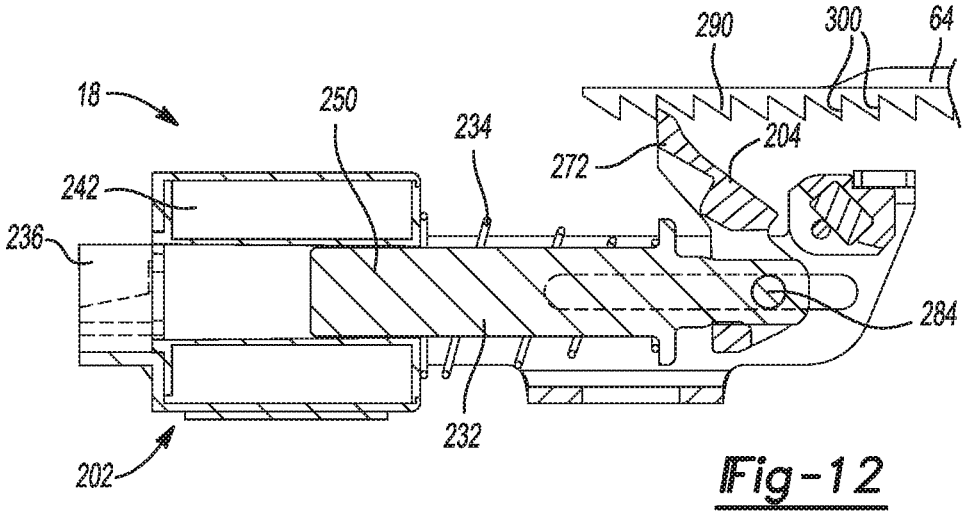

Further motion of the plunger 232 toward the retracted position can engage the pawl tooth 272 to the tooth engagement face 300 of one of the rack teeth 290 and thereafter, the driver 64 can move with the plunger 232 at 1:1 rate. FIG. 12 depicts the driver return assembly 18 and the driver 64 during this portion of the return cycle. Thus, as in the illustrated embodiment, this movement of the plunger 232 toward its retracted position can correspond to movement of the return pawl 204 in a driver homeward direction while the return pawl 204 is in a raised position relative to the nail driver in which the return pawl 204 is engageable with the return rack 206.

Figure 14:
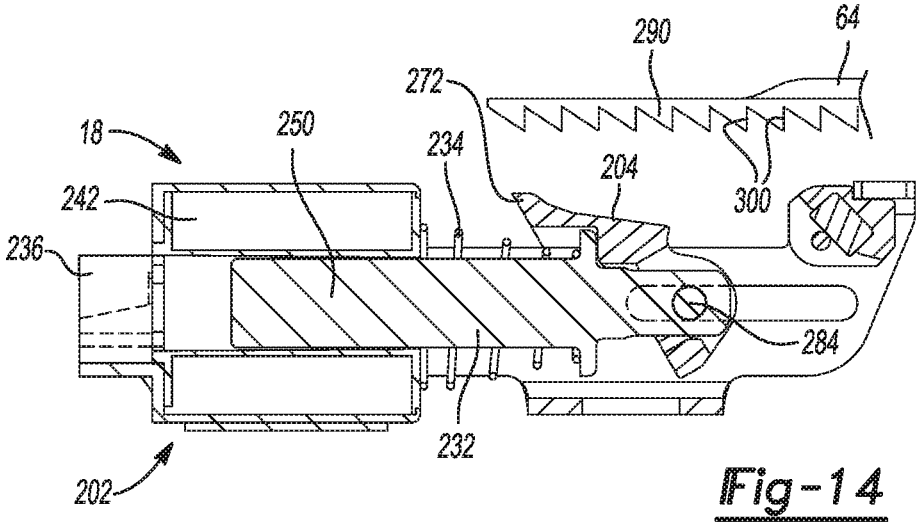

Electric power to the electromagnetic coil 242 can be halted during the return cycle based on any desired criteria. In the particular example provided, the controller 38 (FIG. 2) halts the supply of electric power to the electromagnetic coil 242 after a predetermined amount of time irrespective of whether or not the plunger 232 was actually moved to the retracted position. Alternatively, a sensor (not shown) could be employed to sense a position of the plunger 232 or the return pawl 204 and generate a sensor signal in response thereto that could be received and employed by the controller 38 (FIG. 2) to control the timing at which the supply of electric power to the electromagnetic coil 242 is halted. Once electric power to the electromagnetic coil 242 is halted, the return spring 234 can urge the plunger 232 toward the extended position. Contact between pawl tooth 272 and any of the rack teeth 290 while the plunger 232 is in the retracted position (FIG. 13) or as the plunger 232 is moved toward the extended position (FIG. 14) can cause the return pawl 204 to pivot about the pivot pin 284 so that the pawl tooth 272 moves toward the lowered position. This permits the plunger 232 to be moved to the extended position as depicted in FIG. 14 without causing corresponding movement of the driver 64 toward the driver extended or driven position. Thus, as in the illustrated embodiment, this movement of the plunger 232 toward its extended position can correspond to movement of the return pawl 204 in a driver driven direction while the return pawl 204 is in a lowered position relative to the nail driver 64 in which the return pawl 204 is not engageable with the return rack 206. Also as in the illustrated example, each of the homeward direction and the driven direction along which the return pawl 204 travels can comprise a linearly extending direction. Contact between the return pawl 204 and the link 214 (FIG. 8) when the plunger 232 is in the extended position can drive the return pawl 204 about the pivot pin 284 so that the pawl tooth 272 is moved into and maintained in the lowered position. The return motor 202 can alternate between driving the plunger 232 and/or return pawl 204 in a homeward direction and in a driven direction. In addition, this can include driving or moving the plunger 232 and/or the return pawl 204 in a reciprocating motion.

As noted above, the controller 38 can control operation of the solenoid return motor. The controller 38 can include a circuit 56 that controls the electrical energization and de-energization of the return solenoid 230. For example, the circuit 56 can include a discrete timing chip 48, a series of logic gates 46, a counter 44, and input/output terminals 54 that are linked to a solenoid driver 58 for the solenoid 230. As another example, the circuit 56 can analogously include a CPU 46, memory 44, a clock 48, and an input/output 54 that is linked to a solenoid driver 58 for the solenoid 230. In the CPU example, the CPU 46 can be programmed to energize and de-energize the return solenoid 230. One example of such CPU programming can include: (1) sending a signal to the solenoid driver 58 to energize the solenoid 230 at a predetermined initiation period of time after the CPU initiates firing or driving of the driver 64; then (2) at a predetermined period of energized time after the CPU sends the signal to energize the solenoid 230, the CPU sends a signal to the solenoid driver 58 to de-energize the solenoid 230; next, (3) the CPU increments a cycle register by 1 and compares that to a predetermined number of cycles; and: (4a) if the number in the cycle register is less than a than the predetermined number of cycles, then at a predetermined period of de-energized time after the CPU sends the signal to energize the solenoid, the CPU send a signal to the solenoid driver 58 to again energize the solenoid 230 and return to step (2); or (4b) if the number in the cycle register is equal to the predetermined number of cycles, then the CPU resets the cycle register to zero and stops this solenoid energization/de-energization loop.

It will be appreciated that depending on various factors, including the length of the stroke of the plunger 232, the distance between the driver extended position and the driver return position, and the efficiency with which motion of the plunger 232 is converted into motion of the driver 64, the return motor 202 may have to be operated through several full cycles to completely drive the driver 64 to the driver return position. In the particular example provided, the return motor 202 is cycled through five cycles, corresponding to the predetermined number of cycles, each time that the driver 64 is to be moved to the returned position, with a short dwell of approximately or about 0.05 seconds between the halting of one cycle and the starting of another cycle, corresponding to the predetermined period of de-energized time. It will also be appreciated that during one or more of the cycles, it may not be possible for the plunger 232 to move fully into the retracted position.

Figure 15:
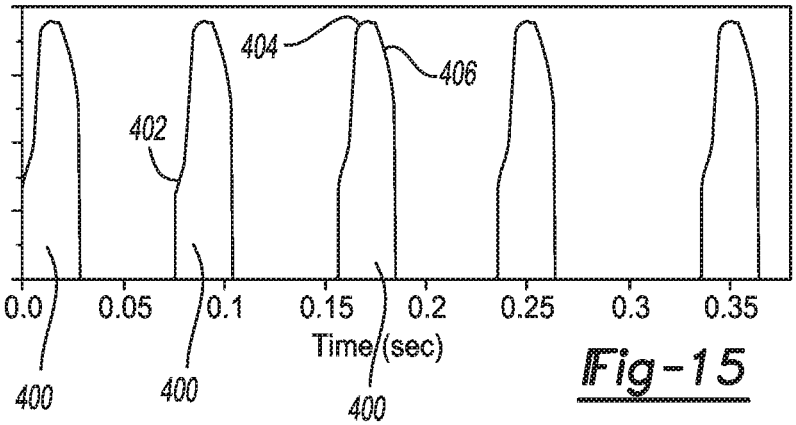
FIG. 15 is a plot depicting the force that is generated by the return mechanism as a function of time.
Figure 16:
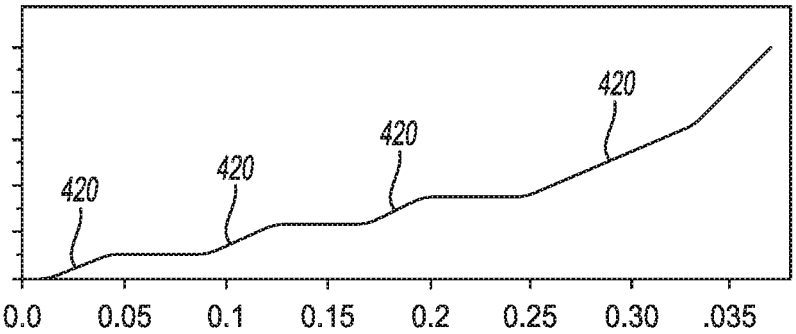
FIG. 16 is a plot depicting movement of a driver or return rack as a function of time.

FIGS. 15 and 16 are exemplary time-based plots depicting force and distance, respectively, as a function of time during the operation of the return motor 202. In FIG. 15, each cycle 400 of the return motor includes a first section 402, in which force is applied by the plunger to engage the return pawl to the rack teeth, a second portion 404 in which movement of the plunger causes initial movement of the driver, and a third portion 406 in which the amount of force to move the driver falls off somewhat due to the inertia/momentum of the (moving) driver. In FIG. 16, corresponding movement of the driver is shown, with segments 420 being the intervals at which the driver is moved.

Figure 17:
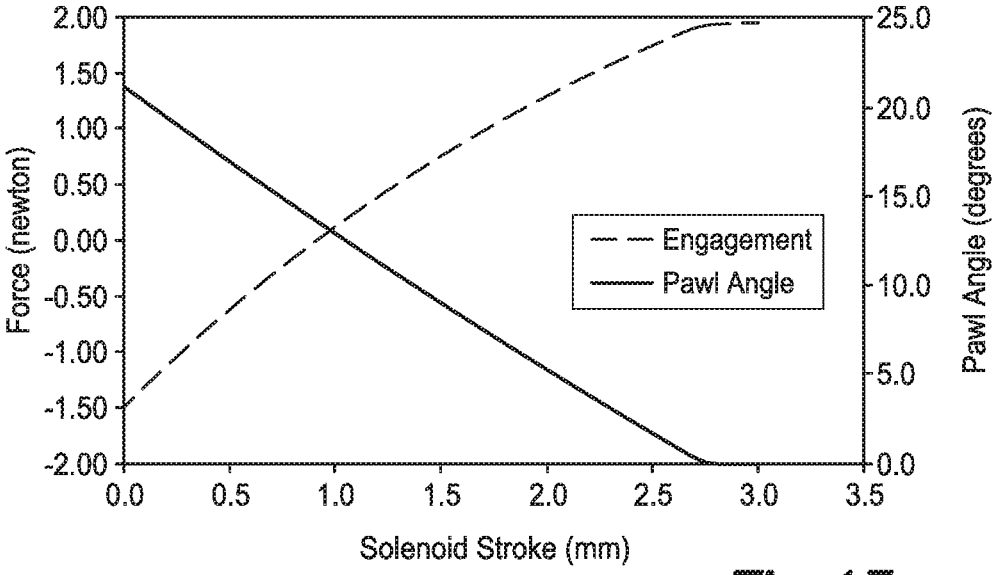
FIG. 17 is a plot that depicts a relationship between force, pawl angle and the stroke of a solenoid.

FIG. 17 depicts two plots that demonstrate the relationships between the length of stroke of the plunger that is required to move the pawl tooth to the raised position and either the pawl angle (shown in solid line) or the force applied to the rack teeth along the driver axis (shown in broken line). The pawl angle is the angle at which the pawl tooth and the rack teeth are inclined relative to the driver axis. As will be appreciated from the figure, selection of a pawl angle for use on the pawl tooth and the rack teeth involves a trade-off between the amount of the stroke of the plunger that is employed to move the pawl tooth from the lowered position to the raised position, and the amount of force that is required to move the pawl tooth to the raised position. In the illustrated embodiment, the length of stroke of the plunger 232 is about 25 mm and the pawl angle through which the return pawl 204 pivots between the lowered and raised positions is about 30 degrees, and the length of the return pawl 204 from the pivot axis of pivot pin 284 to the distal end of the pivot pawl 204 is about 24 mm.

The foregoing description of an example embodiment has been provided for purposes of illustration and description. It is not intended to be exhaustive or to limit the disclosure. Individual elements or features of a particular embodiment are generally not limited to that particular embodiment, but, where applicable, are interchangeable and can be used in a different embodiment, even if not specifically shown or described. The same may also be varied in many ways. Such variations are not to be regarded as a departure from the disclosure, and all such modifications are intended to be included within the scope of the disclosure.

What is claimed is:

1. A cordless electric nailer comprising:

a power take-off assembly positioned and operable to selectively engage a pinch roller against a nail driver having a home position to pinch the nail driver against a battery-powered electric motor driven flywheel and fire the nail driver along a driver axis;

a return rack fixedly coupled to and positioned along a longitudinal length of the nail driver; and a driver return assembly positioned to engage and return the nail driver to the home position, the driver return assembly including:

a return motor operably coupled to a return pawl to alternatingly drive the return pawl along a pawl axis that is parallel to the driver axis in a homeward direction while the return pawl is in a raised position in which the return pawl is engageable with the return rack to drive the nail driver along the driver axis toward the home position, and drive the return pawl along the pawl axis in a driven direction opposite the homeward direction while the return pawl is in a lowered position in which the return pawl is not engageable with the return rack.

2. The cordless electric nailer of claim 1, wherein the return pawl is coupled to a component of the return motor via a pivot pin and the return pawl is pivotable about the pivot pin away from the return motor component into the raised position, and pivotable about the pin toward the return motor component into the lowered position.

3. The cordless electric nailer of claim 2, wherein the return motor comprises a solenoid and the return motor component comprises a solenoid plunger.

4. The cordless electric nailer of claim 3, wherein the pivot pin extends through a distal end of the solenoid plunger.

5. The cordless electric nailer of claim 1, wherein the homeward direction and the driven direction along which the return pawl alternatingly travels each comprise a linearly extending direction.

6. The cordless electric nailer of claim 1, wherein the return motor comprises a solenoid including a biasing member biasing a plunger toward an extended position, and a bumper positioned to engage and stop the plunger in a retracted position.

7. The cordless electric nailer of claim 6, wherein the bumper is a foam bumper.

8. The cordless electric nailer of claim 1, wherein the return motor comprises a solenoid including a plunger and wherein the plunger moves in the homeward direction as the plunger moves toward a retracted position, and wherein the plunger moves in the driven direction as the plunger moves toward the extended position.

9. The cordless electric nailer of claim 1, wherein the power take-off assembly and the nail driver return assembly are both positioned on a same side of the nail driver.

10. The cordless electric nailer of claim 1, wherein the return rack is disposed at an upper end of the nail driver, which upper end is opposite the driving end of the nail driver.

11. The cordless electric nailer of claim 1, wherein the cordless electric nailer is a concrete nailer.

12. A cordless electric concrete nailer comprising:

a power take-off assembly positioned and operable to selectively engage a pinch roller against a concrete nail driver having a home position to pinch the concrete nail driver against a battery-powered electric motor driven flywheel and fire the concrete nail driver along a driver axis;

a return rack fixedly coupled to and positioned along a longitudinal length of the concrete nail driver; and a driver return assembly positioned to return the concrete nail driver to the home position, the driver return assembly including:

a solenoid driving a plunger in a reciprocating motion in a homeward direction along a plunger axis parallel to the driver axis and in a driven direction opposite the homeward direction along the plunger axis;

a return pawl operably coupled to the plunger and pivotable into a pawl raised position in which the pawl is engageable with the return rack during movement of the plunger and the pawl along the plunger axis in the homeward direction to drive the concrete nail driver toward the home position, and pivotable into a pawl lowered position in which the pawl is not engageable with the return rack during movement of the plunger and the pawl along the plunger axis in the driven direction.

13. The cordless electric concrete nailer of claim 12, wherein the driver return assembly further comprises a biasing member biasing the return pawl toward the raised position during of the motion of the plunger in the homeward direction.

14. The cordless electric concrete nailer of claim 12, wherein the driver return assembly further comprises a magnet biasing the return pawl toward the raised position during of the motion of the plunger in the homeward direction.

15. The cordless electric concrete nailer of claim 12, wherein the driver return assembly further comprises a magnet assembly including a magnet positioned to pivot the return pawl toward the raised position via a magnetic force of the magnet during the motion in the homeward direction, and a surface positioned to pivot the return pawl toward the lowered position via engagement of the surface with the return pawl during the motion of the plunger in the driven direction.

16. The cordless electric concrete nailer of claim 12, wherein a surface is positioned to retain the return pawl in the lowered position via engagement of the surface with the return pawl between the reciprocating motion of the plunger.

17. The cordless electric concrete nailer of claim 12, wherein the rack comprises a series of engagement teeth and the return pawl comprises a cooperating engagement pawl tooth.

18. The cordless electric concrete nailer of claim 17, wherein a backside of each of the engagement teeth is angled to engage the cooperating engagement pawl tooth to cause movement of the return pawl toward the lowered position as the return pawl disengages from an adjacent one of the engagement teeth.

19. The cordless electric concrete nailer of claim 12, wherein the plunger moves in the homeward direction as the plunger moves toward a retracted position, and wherein the plunger moves in the driven direction as the plunger moves toward an extended position.

20. The cordless electric concrete nailer of claim 19, wherein the solenoid includes a biasing member that biases the plunger toward the extended position, and a bumper positioned to engage and stop the plunger in the retracted position.

21. The cordless electric concrete nailer of claim 20, wherein the bumper is a foam bumper.

22. The cordless electric concrete nailer of claim 12, wherein the power take-off assembly and the driver return assembly are both positioned on a same side of the nail driver.

23. The cordless electric concrete nailer of claim 22, wherein the return rack is disposed at an upper end of the nail driver, which upper end is opposite the driving end of the nail driver.

24. The cordless electric concrete nailer of claim 12, further comprising a circuit configured to successively energize and de-energize the solenoid a predetermined number of cycles after each firing of the concrete nail driver.

25. The cordless electric concrete nailer of claim 24, wherein the predetermined number of cycles is 5.

26. The cordless concrete nailer of claim 24, wherein the circuit is further configured to de-energize the solenoid a predetermined period of de-energized time between each energization of the solenoid.

27. The cordless electric concrete nailer of claim 26, wherein the predetermined period of de-energized time is about 0.05 seconds.

28. The cordless electric concrete nailer of claim 27, wherein the circuit is further configured to energize the solenoid for a predetermined period of energized time.

29. The cordless electric concrete nailer of claim 12, wherein the return pawl pivots through a pawl angle between the pawl raised and lowered positions that is about 30 degrees.

30. The cordless electric concrete nailer of claim 1, wherein the return motor includes a solenoid and the solenoid includes a biasing member that biases a solenoid plunger toward an extended position, and a bumper positioned to engage and stop the solenoid plunger in a retracted position.

31. The cordless electric concrete nailer of claim 30, wherein the bumper is a foam bumper.

* * * * *